US006478691B2

(12) United States Patent
Okoshi

(10) Patent No.: US 6,478,691 B2
(45) Date of Patent: Nov. 12, 2002

(54) GOLF CLUB HEAD AND METHOD OF MANUFACTURING THE SAME

(75) Inventor: Koji Okoshi, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 10/046,717

(22) Filed: Jan. 17, 2002

(65) Prior Publication Data

US 2002/0065142 A1 May 30, 2002

Related U.S. Application Data

(62) Division of application No. 09/335,504, filed on Jun. 18, 1999, now Pat. No. 6,352,483.

(30) Foreign Application Priority Data

Jun. 24, 1998 (JP) ..... 10-176846

(51) Int. Cl.[7] ..... A63B 53/02

(52) U.S. Cl. ..... 473/324; 473/305; 473/312; 473/345; 29/509

(58) Field of Search ..... 473/305, 312, 473/345, 349, 297, 300, 324; 29/509

(56) References Cited

U.S. PATENT DOCUMENTS 6,352,483 B1 * 3/2002 Okoshi ..... 473/324

* cited by examiner

*Primary Examiner*—Paul T. Sewell
*Assistant Examiner*—Sneh Varma
(74) *Attorney, Agent, or Firm*—Finnegan, Henderson, Farabow, Garrett & Dunner, L.L.P.

(57) ABSTRACT

Disclosed is a golf club head in which a mass-adjusting weight is inserted into the inside of a cylindrical hosel portion, wherein a flange that can be deformed in a radial direction of the hosel portion is formed in a peripheral portion of the foregoing weight and the diameter of the flange is increased so as to fix the foregoing weight to the foregoing hosel portion.

4 Claims, 3 Drawing Sheets

GOLF CLUB HEAD AND METHOD OF MANUFACTURING THE SAME

This is a division of application Ser. No. 09/335,504, filed Jun. 18, 1999, now U.S. Pat. No. 6,352,483 which is incorporated herein by reference.

BACKGROUND OF THE INVENTION

The present invention relates to a golf club head having a mass-adjusting weight inserted into the inside of a hosel portion and a method of manufacturing the same, more particularly, to a golf club head that permits strongly fixing a mass-adjusting weight even where the inner surface of the hosel portion is inversely tapered such that the inner diameter of the hosel portion is greater on the side of the bottom than on the side of the opening and a method of manufacturing the same.

In assembling a golf club, a golf club head is generally required to exhibit a high accuracy in mass, making it necessary to correct an error of mass that is generated in the casting step or the like. As a means for adjusting the mass of a golf club head, a mass-adjusting weight is inserted into the inside of a hosel portion.

The mass-adjusting weight is simply dropped into the inside of the hosel portion. Alternatively, a thin flange is formed in a peripheral portion of the weight, and the flange is pressed against the inner surface of the hosel portion so as to be crushed when the weight is inserted into the inside of the hosel portion, thereby obtaining a caulking effect. However, the caulking 20 effect cannot be obtained in the case where the inner surface of the hosel portion is inversely tapered such that the inner diameter of the hosel portion is larger on the side of the bottom than on the side of the opening, making it impossible to fix strongly the mass-adjusting weight to the hosel portion. If the fixing of the mass-adjusting weight is insufficient, an adhesive for bonding a golf club shaft to the hosel portion leaks into the inner portion of the club head to be solidified. The solidified adhesive is dropped as a small lump into the inner portion of the club head when a golf ball is hit by the golf club. Also, the weight itself is vibrated within the hosel portion to generate noise when the golf club is swung or when a golf ball is hit by the golf club.

SUMMARY OF THE INVENTION

The object of the present invention is to provide a golf club head that makes it possible to fix strongly a mass-adjusting weight even where the inner surface of the hosel portion is inversely tapered and a method of manufacturing the same.

To achieve the above-noted object, the present invention provides a golf club head in which a mass-adjusting weight is inserted into the inside of a cylindrical hosel portion, characterized in that a flange that can be deformed in a radial direction of hosel portion is formed in a peripheral portion of the weight and the diameter of the flange is increased to fix the weight to the hosel portion.

Since a flange that can be deformed in a radial direction of the hosel portion is formed in a peripheral portion of the weight and the weight is fixed by increasing the diameter of the flange, it is possible to fix strongly a mass-adjusting weight even where the inner surface of the hosel portion is inversely tapered. Particularly, if an annular groove extending in a circumferential direction of the hosel portion is formed in the flange, the flange can be deformed easily in a radial direction of the hosel portion.

The present invention also provides a method of manufacturing a golf club head, characterized by comprising the step of forming a flange that can be deformed in a radial direction of the hosel portion in a peripheral portion of a mass-adjusting weight, the step of inserting the foregoing weight into the inside of a hosel portion of a golf club head, and the step of applying a pressurizing force to the flange in an axial direction of the hosel portion to increase the diameter of the flange portion and, thus, to fix the weight to the hosel portion by caulking.

The weight can be fixed by caulking by inserting the weight into the inside of the hosel portion of a golf club head, followed by applying a pressurizing force to the flange in an axial direction of the hosel portion to increase the diameter of the flange. The particular caulking fixation can be achieved easily by using a caulking tool that can be inserted into the inside of the hosel portion and can abut against the flange.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION OF THE PREFERRED EMBODIMENTS

Figure 1:
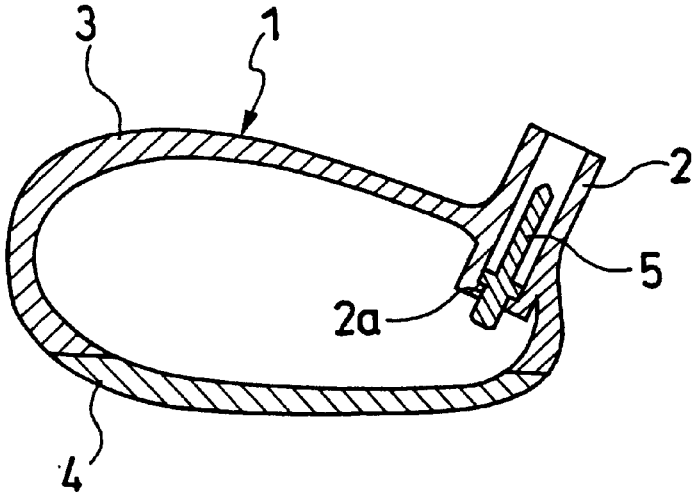
FIG. 1 is a cross sectional view showing a golf club head according to one embodiment of the present invention.

FIG. 1 exemplifies a golf club head according to one embodiment of the present invention. As shown in the drawing, the golf club head 1 is of a hollow structure including an outer housing 3 provided with a hosel portion 2 and a sole portion 4 integrally bonded to the outer housing 3. The hosel portion 2 is cylindrical and is provided with a through-hole 2*a* at the bottom.

Figure 2:
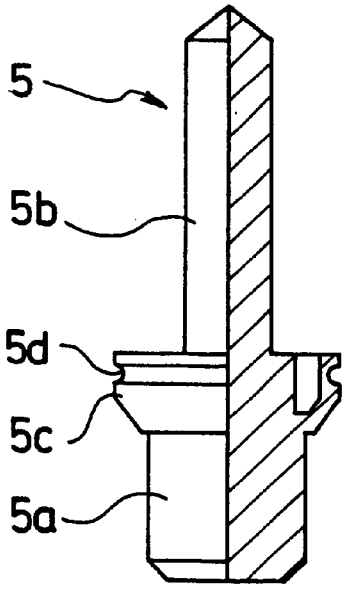
FIG. 2 is a side view, partly broken away, exemplifying a mass-adjusting weight used in the golf club head of the present invention.

A mass-adjusting weight 5 is inserted into the inside of the hosel portion 2. As shown in FIG. 2, the weight 5 includes a weight body 5*a* that is dropped into the through-hole 2*a* at the bottom of the hosel portion 2 and a projecting portion 5*b* extending upward above the weight body 5*a*. The mass can be set at an optional value by adjusting the length of the projecting portion 5*b*. A cylindrical flange 5*c* projecting in an axial direction of the hosel portion is formed in the peripheral portion of the weight body 5*a*. An annular groove 5*d* extending in a circumferential direction of the hosel portion is formed on the outer surface of the flange 5*c*. It follows that, if a pressurizing force is applied to the flange 5*c* in an axial direction of the hosel portion, the flange 5*c* can be deformed in a manner to fall down outward in a radial direction of the hosel portion with the annular groove 5*d* acting as a bending point. The annular groove 5*d* should be formed in the vicinity of the largest diameter position of the flange 5*c* in the diameter-increased state.

Figure 3:
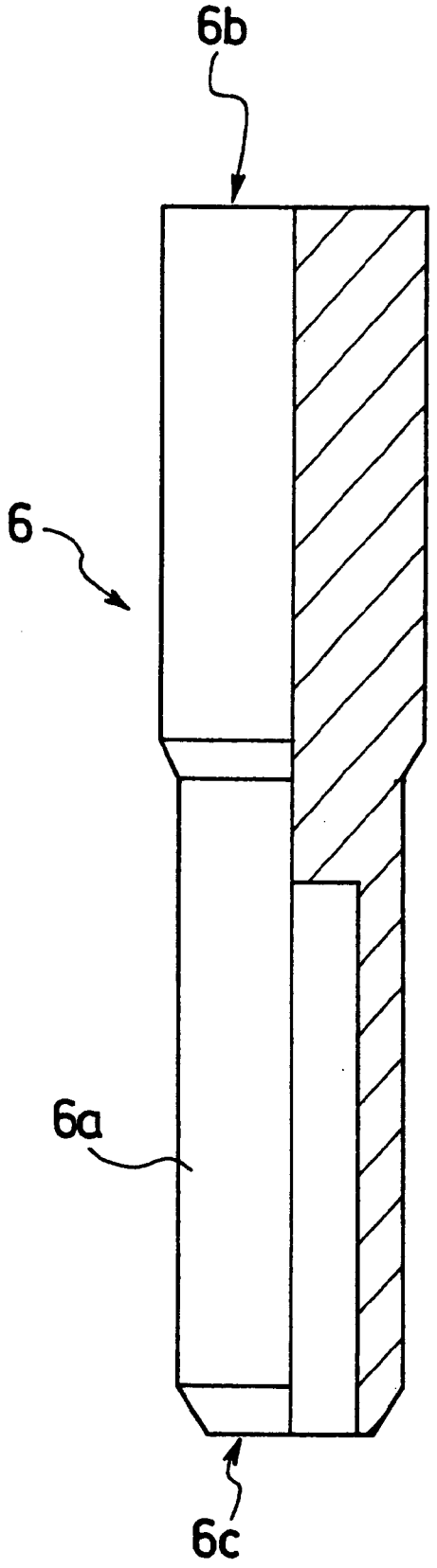
FIG. 3 is a side view, partly broken away, exemplifying a caulking tool used in a method of the present invention.

In mounting the mass-adjusting weight 5 to the hosel portion 2, it is possible to use a caulking tool 6 shown in FIG. 3. A lower end portion 6*a* of the caulking tool 6 has an outer diameter smaller than the inner diameter of the hosel portion 2 and, thus, can be inserted into the inside of the hosel portion 2. The caulking tool 6 is formed cylindrical so as not to be brought into contact with the projecting portion 5*b* of the weight 5. Also, an upper end face 6*b* of the caulking tool 6 constitutes a hitting plane that is hit by a hammer or the like. On the other hand, a lower end face 6*c* of the caulking tool 6 that is allowed to abut against the flange 5*c* is tapered in a manner to expand outward the flange 5*c* in a radial direction of the hosel portion.

Figure 4A:
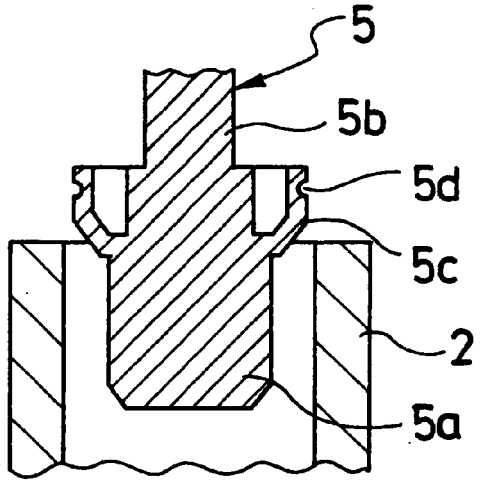
FIGS. 4(*a*) to 4(*c*) are cross sectional views each showing a hosel portion in a method of manufacturing a golf club head according to an embodiment of the present invention.
Figure 4B:
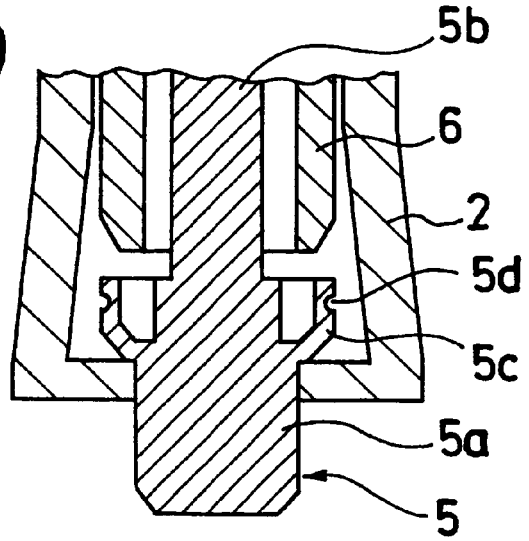
Figure 4C:
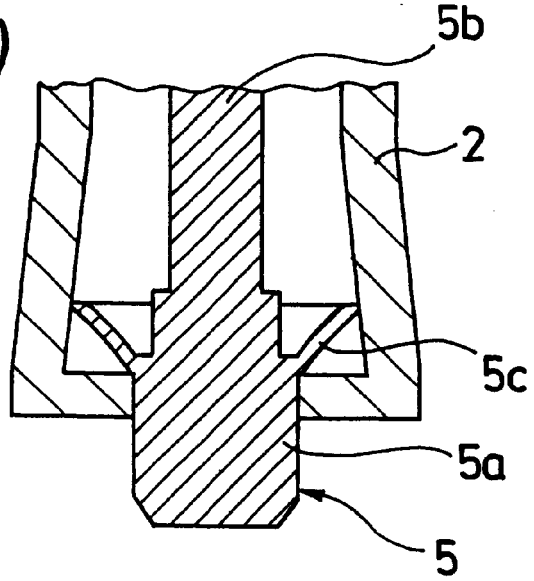

FIGS. 4(*a*) to 4(*c*) exemplify the method of the present invention for manufacturing a golf club head. It should be noted that the golf club head 1 shown in FIG. 1 is prepared by casting or the like. When prepared by casting, the golf club head 1 can have an error in mass, making it necessary to correct the error by using the mass-adjusting weight 5.

In the first step, the mass-adjusting weight 5 provided with the flange 5*c* is prepared and, then, dropped into the inside of the hosel portion 2, as shown in FIG. 4(*a*). Then, a pressurizing force is applied to the flange 5*c* in an axial direction of the hosel portion by using the caulking tool 6, as shown in FIG. 4(*b*). In this step, the flange 5*c* is pushed outward in a radial direction of the hosel portion by the lower end face 6*c* of the caulking tool 6, said lower end face 6*c* having a tapering angle, with the result that the weight is fixed by caulking to the hosel portion 2 as shown in FIG. 4(*c*).

As described above, the flange 5*c* that can be deformed in a radial direction of the hosel portion is formed in a peripheral portion of the weight 5 in the present invention. The weight 5 is dropped into the inside of the hosel portion 2, followed by increasing the diameter of the flange 5*c*, with the result that the mass-adjusting weight 5 can be strongly fixed by caulking to the hosel portion 2. Particularly, where the hosel portion 2 is inversely tapered such that the inner diameter of the hosel portion 2 is greater on the side of the bottom than that on the side of the opening, a clearance is formed between the flange 5*c* and the inner surface of the hosel portion 2 when the weight 5 is dropped into the inside of the hosel portion 2. Nevertheless, the weight 5 can be fixed strongly to the hosel portion 2 in the present invention by increasing the diameter of the flange 5*c*, as described above.

It should also be noted that, since the mass-adjusting weight 5 is fixed satisfactorily in the present invention, it is possible to prevent an adhesive used for bonding the golf club shaft to the hosel portion 2 from leaking into the inside of the golf club head 1 to form a small lump present inside the golf club head 1. Then, it is also possible to prevent the weight 5 from being shaken within the hosel portion 2. It follows that, when the golf club is swung or hits a golf ball, it is possible to prevent noise from being produced by the weight 5 being shaken within the hosel portion 2 or the small lump of the adhesive present inside the head 1.

In the present invention, the shape of the mass-adjusting weight is not limited to that employed in the embodiment described above and can be modified in various fashions depending on the requirement. Also, the material of the mass-adjusting weight is not particularly limited in the present invention. However, it is desirable to use aluminum, brass, etc. for forming the weight in order to permit the weight to be deformed easily as desired and to be fixed strongly to the hosel portion.

Although the preferred embodiment of the present invention has been described in detail, it should be understood that various changes, substitutions and alterations can be made therein without departing from spirit and scope of the inventions as defined by the appended claims.

What is claimed is:

1. A method of manufacturing a golf club head, comprising the step of forming a flange that can be deformed in a radial direction of a hosel portion in a peripheral portion of a mass-adjusting weight, the step of inserting the weight into the inside of the hosel portion of the golf club head, and the step of applying a pressurizing force to said flange in an axial direction of said hosel portion so as to increase the diameter of the flange portion and, thus, to fix said weight to the hosel portion by caulking.

2. A method of manufacturing a golf club head according to claim 1, wherein a caulking tool that can be inserted into the inside of said hosel portion and can abut against said flange is used in the step of applying a pressurizing force to said flange in an axial direction of the hosel portion.

3. A method of manufacturing a golf club head according to claim 2, wherein said caulking tool is cylindrical, and the outer diameter of the cylindrical caulking tool is smaller than the inner diameter of the hosel portion.

4. A method of manufacturing a golf club head according to claim 2, wherein a tapering angle is imparted to an end face of the caulking tool which abuts against said flange.

* * * * *